US005117092A

United States Patent [19]

Shimizu et al.

[11] Patent Number: 5,117,092

[45] Date of Patent: May 26, 1992

[54] CORDLESS IRON

[75] Inventors: Masao Shimizu, Nishinomiya; Yoshinori Kataoka, Osaka; Naruaki Akai, Takarazuka, all of Japan

[73] Assignee: Matsushita Electric Industrial Co., Ltd., Japan

[21] Appl. No.: 550,279

[22] Filed: Jul. 9, 1990

[30] Foreign Application Priority Data

Jul. 20, 1989 [JP] Japan ..... 1-187858
Jul. 20, 1989 [JP] Japan ..... 1-187861

[51] Int. Cl.[5] ..... H05B 1/02; D06F 75/26

[52] U.S. Cl. ..... 219/247; 38/82; 219/251; 219/506

[58] Field of Search ..... 219/242, 245-247, 219/256, 251, 506; 38/74, 82, 142

[56] References Cited

U.S. PATENT DOCUMENTS 2,714,650 8/1955 Werner .
2,820,877 1/1958 Oates .
3,398,260 8/1968 Martens .
3,745,676 7/1973 Dikoff ..... 38/142 X
3,760,149 9/1973 Harsamyi ..... 219/247
4,650,268 3/1987 Dobson et al. .
4,827,104 5/1989 Foster ..... 219/246 X
4,856,212 8/1989 Dikoff ..... 219/247 X

FOREIGN PATENT DOCUMENTS 225298 6/1987 European Pat. Off. ..... 219/247
279780 8/1988 European Pat. Off. ..... 219/247
311003 4/1989 European Pat. Off. ..... 219/247
59-232597 12/1984 Japan .
64-52500 2/1989 Japan .
1-94900 4/1989 Japan ..... 219/247
2221925 2/1990 United Kingdom ..... 219/247

*Primary Examiner*—Anthony Bartis
*Attorney, Agent, or Firm*—Lowe, Price, LeBlanc & Becker

[57] ABSTRACT

A cordless iron includes a stand and an iron body placeable on and detachable from the stand. The iron body has a sole plate. The sole plate of the iron body is heated when the iron body is placed on the stand. An electrically powered temperature sensor senses the temperature of the sole plate of the iron body and outputs a signal representative of that sensed temperature. An alarm device responsive to the signal outputted from the temperature sensor serves to indicate that the sensed temperature drops to or below a reference temperature. The temperature sensor is kept activated when the iron body is detached from the stand.

10 Claims, 12 Drawing Sheets

CORDLESS IRON

BACKGROUND OF THE INVENTION

1. Field of the Invention

This invention relates to a cordless electric iron.

2. Description of the Prior Art

U.S. Pat. Nos. 2,714,650 and 3,760,149 disclose cordless electric irons in which iron bodies can be horizontally supported on stands.

U.S. Pat. No. 2,820,877 and Japanese published patent application 59-232597 disclose cordless irons in which iron bodies can be obliquely supported on stands.

U.S. Pat. Nos. 3,398,260 and 4,650,268 disclose cordless irons in which iron bodies can be placed on stands in a self-supporting manner.

In each of these prior art cordless irons, the iron body has a heater circuit and power feed terminals electrically connected to the heater circuit. The stand has electrodes which can be connected to the power feed terminals of the iron body. An electric cord leads from the electrodes of the stand. When the iron body is placed on the stand, the heater circuit is activated so that a sole plate of the iron body is heated. When the iron is used, the iron body is detached from the stand and the heater circuit is deactivated. Thus, during the use of the iron, the temperature of the sole plate of the iron body gradually drops. To prevent a considerable drop in the temperature of the sole plate of the iron body, it is necessary to frequently place the iron body back on the stand.

Japanese published unexamined patent application 64-52500 discloses an advanced cordless iron including a warning device and also a memory for storing a characteristic of an estimated drop in a temperature of the sole plate of the iron body which occurs during the use of the iron. At the moment of the detachment of the iron body from a stand, the temperature of the sole plate of the iron body is detected. This detected temperature and the estimated temperature drop characteristic are used to determine a reference time corresponding to a moment at which the temperature of the sole plate of the iron body drops to an unacceptable level. During the use of the iron, when the reference time elapses, the warning device is activated.

The cordless iron of Japanese patent application 64-52500 has the following problem. During the use of the iron, an actual drop in the temperature of the sole plate of the iron body depends on thermal conditions such as the heat capacity or the specific heat of a cloth pressed by the iron. Since the estimated temperature drop characteristic is predetermined for typical clothes, the warning process tends to be unreliable when the iron acts on clothes much different from the typical clothes in thermal conditions.

SUMMARY OF THE INVENTION

It is an object of this invention to provide an improved cordless iron.

According to a first aspect of this invention, a cordless iron includes a stand, an iron body placed on and detachable from the stand and a sole plate. The stand includes means for heating the sole plate of the iron body when the iron body is placed on the stand. The iron body includes means for sensing a temperature of the sole plate of the iron body to output a signal representative of the sensed temperature of the sole plate of the iron body. The iron body further includes means responsive to the signal outputted from the sensing means for informing that the sensed temperature drops to or below a reference temperature and means for keeping the sensing means activated when the iron body is detached from the stand.

According to a second aspect of this invention, a cordless iron includes a stand, an iron body placed on and detached from the stand and having a sole plate. The stand includes means for heating the sole plate of the iron body when the iron body is placed on the stand. The iron body includes means for sensing a temperature of the sole plate of the iron body to output a signal representative of the sensed temperature of the sole plate of the iron body. The iron body further includes means responsive to the signal outputted from the sensing means for indicating that the sensed temperature drops to or below a reference temperature and means for keeping the sensing means activated when the iron body is detached from the stand.

According to a third aspect of this invention, a cordless iron includes a stand, an iron body placeable on and detachable from the stand and a sole plate. The stand includes means for heating the sole plate of the iron body when the iron body is placed on the stand. The iron body includes means for sensing a temperature of the sole plate of the iron body of output a signal representative of the sensed temperature to the sole plate of the iron body. The iron body further includes means responsive to the signal outputted from the sensing means for auditorily informing that the sensed temperature drops to or below a reference temperature, means responsive to the signal outputted from the sensing means for visually informing that the sensed temperature drops to or below the reference temperature and means for keeping the sensing means activated when the iron body is detached from the stand.

According to a fourth aspect of this invention, a cordless iron includes a stand; an iron body placable on and detachable from the stand and a sole plate. The stand includes means for heating the sole plate of the iron body when the iron body is placed on the stand. The iron body includes means for sensing a temperature of the sole plate of the iron body to output a signal representative of the sensed temperature of the sole plate of the iron body. The iron body further includes means responsive to the signal outputted from the sensing means for informing that the sensed temperature drops to or below the reference temperature and means for keeping the sensing means activated when the iron body is detached from the stand. The keeping means includes a power supply, means for charging the power supply when the iron body is placed on the stand and means for deactivating the informing means when the iron body is placed on the stand.

According to a fifth aspect of this invention, a cordless iron includes a stand, an iron body placeable on and detachable from the stand and having a sole plate. The stand includes means for heating the sole plate of the iron body when the iron body is placed on the stand. The iron body includes means for deactivating the heating means when the iron body is detached from the stand. As the temperature of the sole plate of the iron body gradually drops when the iron body is detached from the stand; means for sensing the temperature of the sole plate outputs a signal representative of the sensed temperature of the sole plate of the iron body, The iron body further includes means responsive to the signal outputted from the sensing means for, while the iron body remains detached from the stand, informing that the sensed temperature drops into a predetermined range, and means for keeping the sensing means activated to enable the sensing means to continuously sense the temperature of the sole plate of the iron body while the iron body remains detached from the stand, The informing means is responsive to the signal which is currently outputted from the sensing means while the iron body remains detached from the stand.

DESCRIPTION OF THE FIRST PREFERRED EMBODIMENT

Figure 1:
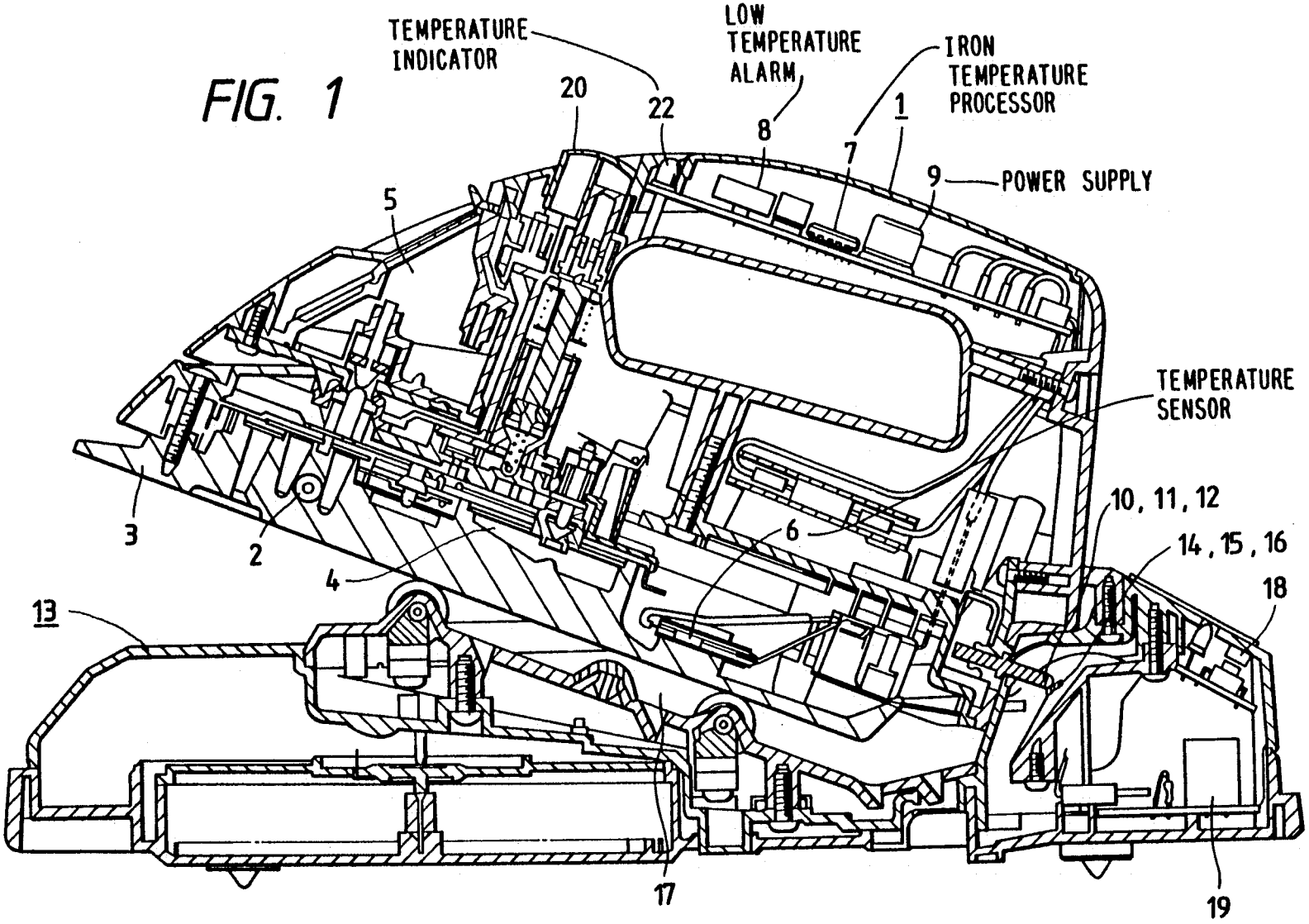
FIG. 1 is a sectional view of a cordless iron according to a first embodiment of this invention.
Figure 2:
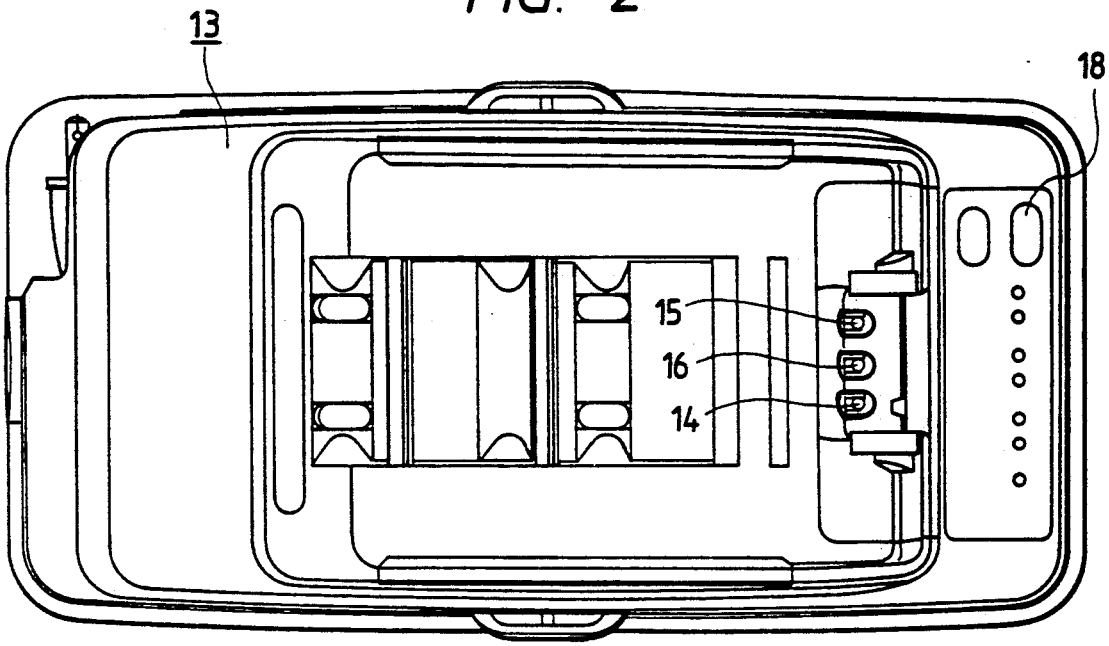
FIG. 2 is a plan view of the stand of FIG. 1.
Figure 3:
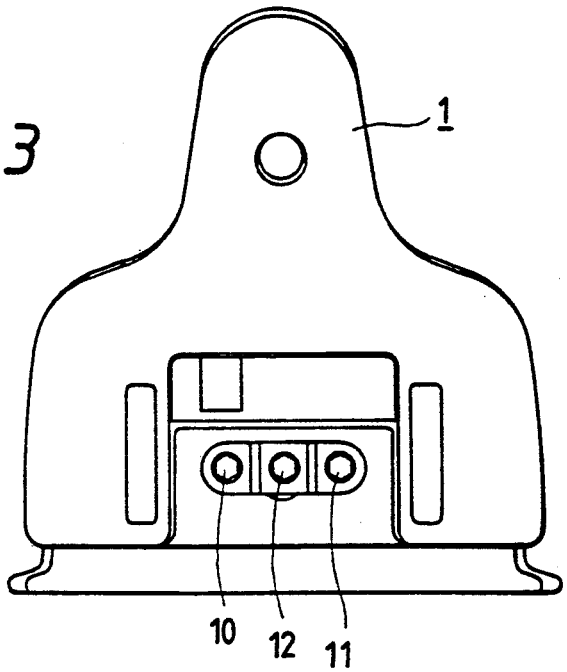
FIG. 3 is a rear view of the iron body of FIG. 1.
Figure 4:
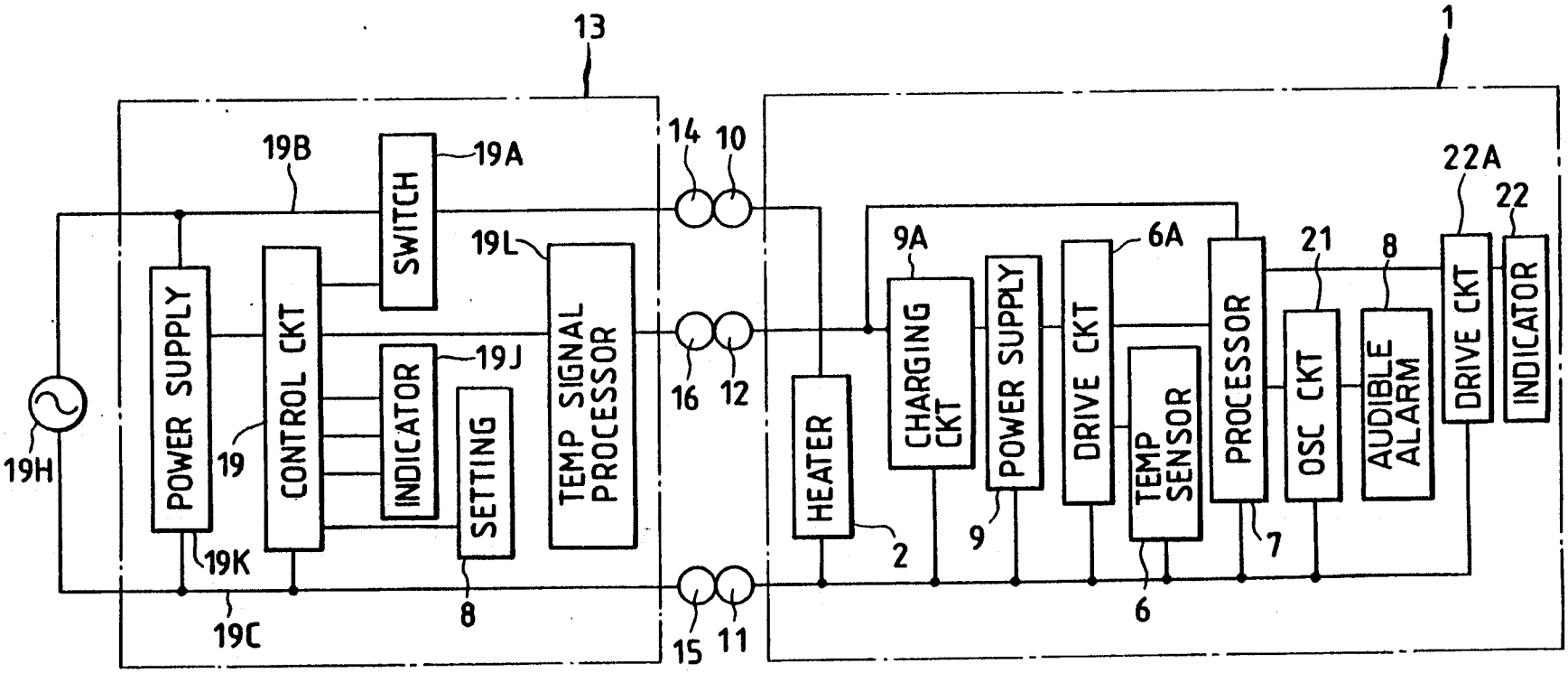
FIG. 4 is a block diagram of an electric part of the cordless iron of FIG. 1.

With reference to FIGS. 1-5, an iron body 1 has a sole plate (base) 3 in which a heater 2 is provided. The heater 2 serves to heat the sole plate 3. A vaporizing chamber 4 is formed in the sole plate 3. The iron body 1 has a tank 5 storing water and extending above the sole plate 3. The tank 5 communicates with the vaporizing chamber 4 to feed the water to the vaporizing chamber 4. The iron body 1 contains a temperature sensor 6 such as a thermistor for sensing the temperature of the sole plate 3. An output signal from the temperature sensor 6 is processed by a temperature signal processor 7 contained in the iron body 1. An audible alarm device 8 such as a buzzer and a power supply 9 are contained in the iron body. The temperature signal processor 7 and the buzzer 8 can be powered by the power supply 9. The power supply 9 can be a capacitor or a rechargeable battery. The iron body 1 is provided with power feed terminals 10 and 11 electrically connected to the heater 2. In addition, the iron body 1 is provided with a signal output terminal 12 electrically connected to the temperature signal processor 7.

The iron body 1 can be placed on and detached from a stand 13. When the iron body 1 is placed on the stand 13, the heater 2 in the iron body 1 can be supplied with an electric power via the stand 13 so that the sole plate 3 of the iron body 1 can be heated by the heater 2. When the iron body 1 is detached from the stand 13, the supply of the electric power to the heater 2 in the iron body 1 is inhibited. When the iron body 1 is placed on the stand 13, the power supply 9 is charged via the stand 13. When the iron body 1 is detached from the stand 13, the power supply 9 feeds drive currents to the temperature sensor 6, the temperature signal processor 7, the buzzer 8, and other circuits within the iron body 1.

The temperature sensor 6 is connected to the power supply 9 via a resistor R4. This resistor R4 is contained in a drive circuit 6A for the temperature sensor 6.

The stand 13 is provided with power feed electrodes 14 and 15 and a signal input terminal 16 which contact the power feed terminals 10 and 11 and the output terminal 12 of the iron body 1 respectively when the iron body 1 is placed on the stand 13. The stand 13 has a support portion 17 which can abut a rear part of the iron body 1.

A temperature setting button 18 contained in the stand 13 can generate a signal for determining a setting temperature T of the sole plate 3. The stand 13 contains a temperature controller 19 which can receive the output signal from the temperature signal processor 7 via the terminals 12 and 16. The temperature controller 19 also receives the output signal from the temperature setting button 18. The temperature controller 19 includes a relay switch 19A for allowing and inhibiting the supply of electric power to the heater 2. When the iron body 1 is placed on the stand 13, the heater 2 is electrically connected to an electric cord (not shown) via the terminals 10, 11, 14, and 15 and also the relay switch 19A. The electric cord is connected to a commercial power supply 19H (see FIG. 4) during the use of the iron. The temperature controller 19 controls the supply of the electric power to the heater 2 in accordance with the output signals from the temperature signal processor 7 and the temperature setting button 18 to regulate the temperature of the sole plate 3 at the setting temperature.

A pair of power lines 19B and 19C extend in the stand 13. The power lines 19B and 19C can be connected to the commercial power supply 19H via the electric cord. One end of the heater 2 can be connected to the power line 19B via the terminals 10 and 14 and the relay switch 19A. The other end of the heater 2 can be connected to the power line 19C via the terminals 11 and 15. The relay switch 19A is associated with a relay winding 19D which is connected to a dc power line 19E via a switching transistor 19F. The temperature controller 19 includes a microprocessor or microcomputer IC1 having a combination of a processing section, a ROM, a RAM, and an input/output circuit. The microprocessor IC1 operates in accordance with a program stored in the ROM. The microprocessor IC1 is connected to the switching transistor 19F. The microprocessor IC1 makes the switching transistor 19F conductive and non-conductive, energizing and deenergizing the relay winding 19D and thereby closing and opening the relay switch 19A. When the relay switch 19A is closed and opened, the heater 2 is activated and deactivated respectively. In this way, the microprocessor IC1 controls the activation and the deactivation of the heater 2.

A power supply circuit 19K derives a dc power from the power of the commercial power supply 19H. The dc power line 19E is subjected to the dc power generated by the power supply circuit 19K. The microprocessor IC1 is activated by the dc power from the power supply circuit 19K.

The temperature signal processor 7 includes an operational amplifier IC2 serving as a comparator for comparing the voltage of the output signal from the temperature sensor 6 with a reference voltage, that is, comparing the temperature of the sole plate 3 with a reference temperature. The output signal from the comparator IC2 is transmitted to the microprocessor IC1 via a transistor Q4, the terminals 12, 16, and a photo-coupler 19G. The photo-coupler 19G is contained in a temperature signal processor 19L. The duty cycle of the signal outputted from the temperature signal processor 7 to the microprocessor IC1 represents the temperature of the sole plate 3 of the iron body 1 which is sensed by the temperature sensor 6. When the iron body 1 is detached from the stand 13, the comparator IC2 can be activated by the power supply 9.

The microprocessor IC1 is connected to the temperature setting button 18 and thus receives the output signal from the temperature setting button 18 which represents the setting temperature T. In addition, the microprocessor IC1 receives the output signal from the temperature signal processor 7 which represents the actual temperature of the sole plate 3 of the iron body 1. While the iron body 3 is placed on the stand 13, the microprocessor IC1 controls the activation and deactivation of the heater 2 in response to the output signals from the temperature setting button 18 and the temperature signal processor 7 so that the actual temperature of the sole plate 3 of the iron body 1 can be maintained at essentially the setting temperature T.

An indicator assembly 19J is connected to the microprocessor IC1. The microprocessor IC1 controls the indicator assembly 19J so that the indicator assembly 19J can indicate the setting temperature T determining by the output signal from the temperature setting button 18.

One end of the power supply 9 can be connected to the power line 19B via a transistor Q1, diodes, resistors, and the terminals 12 and 16. The other end of the power supply 9 can be connected to the power line 19C via the terminals 11 and 15. The transistor Q1 serves as a switch for connecting and disconnecting the power supply 9 to and from the power line 19B. When the iron body 1 is placed on the stand 13, the transistor Q1 is conductive so that the power supply 9 can be charged. The transistor Q1 is contained in a charging circuit 9A for the power supply 9. The charged power supply 9 can feed drive currents to the circuits within the iron body 1 when the iron body 1 is detached from the stand 13.

The audible alarm device 8 includes a piezoelectric resonator or a ceramic resonator connected in an oscillation circuit 21 disposed within the iron body 1. The oscillation circuit 21 includes a known combination of gates formed by an integrated circuit chip IC3. When the oscillation circuit 21 is activated, the audible alarm device 8 generates sound having a frequency essentially equal to the resonance frequency of the resonator. The oscillation circuit 21 is powered by the voltage across a capacitor C1. The capacitor C1 is connected to the power supply 9. A transistor Q3 connected to the capacitor C1 serves as a switch for selectively discharging the capacitor C1. The transistor Q3 is controlled by a transistor Q2 whose base is connected to the collector of the transistor Q4.

The temperature signal processor 7 includes an operational amplifier IC4 serving as a comparator for comparing the voltage of the output signal from the temperature sensor 6 with a reference voltage, that is, comparing the temperature of the sole plate 3 with a reference temperature which is determined by resistors R1, R2, and R3. A visually informing device or an indicator 22 such as an LED located in the iron body 1 is connected across the power supply 9 via a transistor Q5 controlled by the output signal from the comparator IC4. The transistor Q5 is contained in an indicator drive circuit 22A. The transistor Q5 serves as a switch for selectively activating and deactivating the LED 22 in response to the output signal from the comparator IC4.

In addition, the output terminal of the comparator IC4 is connected to the capacitor C1 and the oscillation circuit 21. The oscillation circuit 21 can be activated and deactivated in response to the output signal from the comparator IC4.

Voltages V1, V2, and V3 (see FIG. 5) determined by voltage reference diodes ZD1 and ZD2 and resistors are set as $V1<V2<V3$ in the case where the iron body 1 is placed on the stand 13. The voltage V1 relates to a voltage of the power supply 9. The voltage V2 relates to a voltage driving the comparator IC2, the integrated circuit chip IC3, and others within the iron body 1. The voltage V3 relates to a voltage dependent on the output signal from the comparator IC2 and also relates to the voltage fed from the power line 19B via the terminals 12 and 16. For example, the voltage reference diodes ZD1 and ZD2 are chosen so that the voltages V1, V2, and V3 will be equal to about 5, 15, and 100 volts respectively in the case where the iron body 1 is placed on the stand 13.

Figure 6:
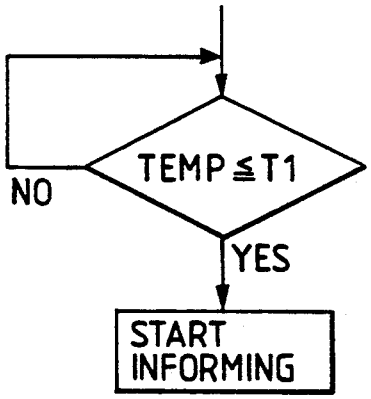
FIG. 6 is a flow diagram of a part of operation of the cordless iron of FIG. 1.
Figure 7:
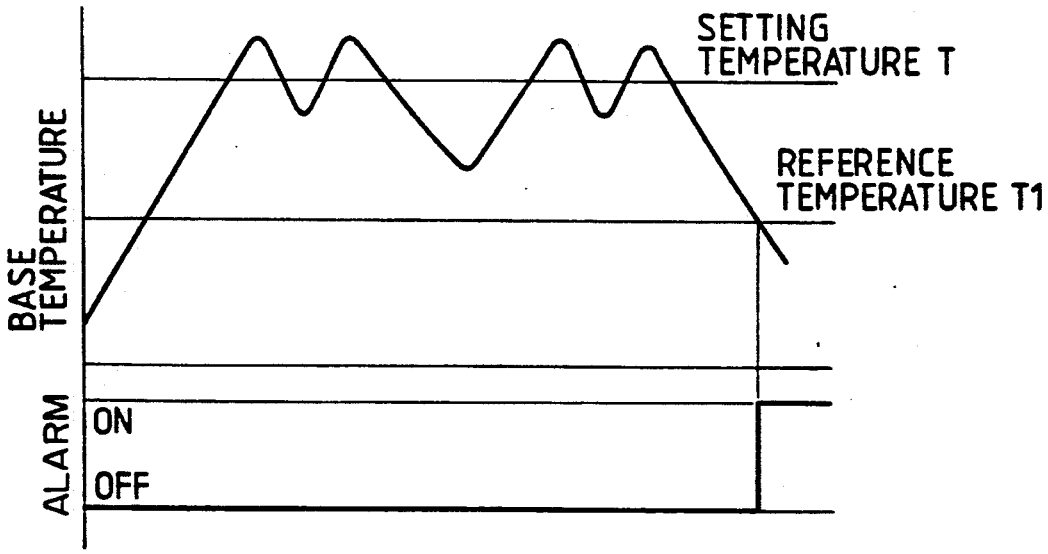
FIG. 7 is a timing diagram related to the operation of FIG. 6.

When the iron body 1 is detached from the stand 13, the terminals 10–12 of the iron body 1 are disconnected from the terminals 14–16 of the stand 13 so that the supply of the electric power to the circuits of the iron body 1 via the stand 13 is interrupted. As a result, the voltages V1, V2, and V3 move into the relation as $V1>V2>V3$. Thus, the transistors Q2 and Q3 are maintained in non-conductive states while the capacitor C1 is held in a charged state. In this case, when the iron is used and the temperature of the sole plate 3 drops to a reference temperature T1 determined by the resistors R1–R3, the output voltage V4 from the comparator IC4 changes from a low level to a high level so that the oscillation circuit 21 is activated. The activation of the oscillation circuit 21 enables the audible alarm device 8 to generate the warning sound. These processes are shown in FIGS. 6 and 7.

Figure 8:
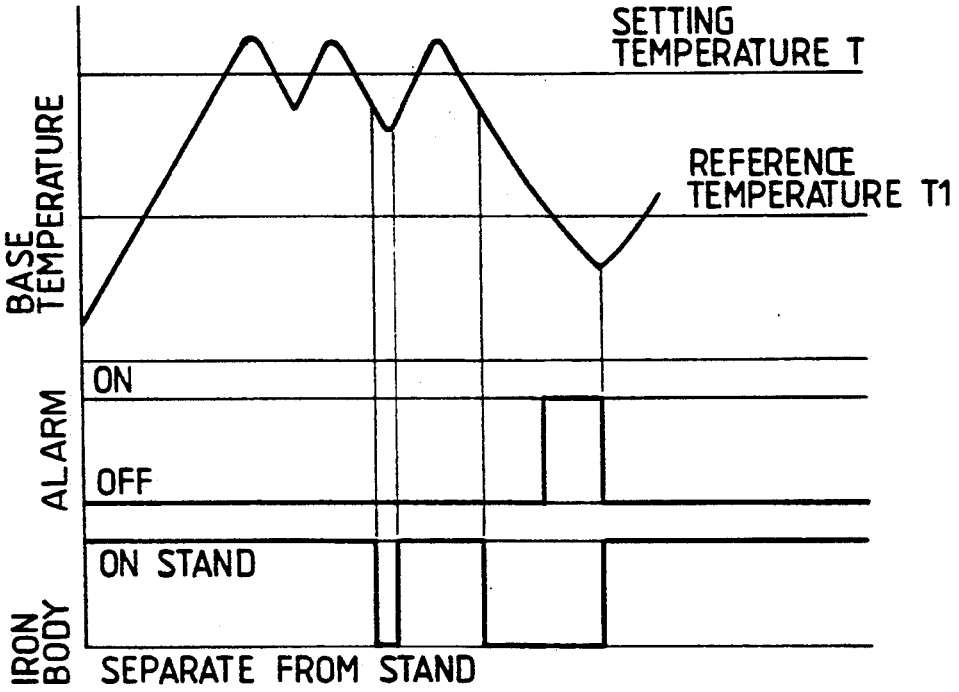
FIG. 8 is a timing diagram related to a part of operation of the cordless iron of FIG. 1.

Under the conditions where the audible alarm device 8 is activated, when the iron body 1 is placed on the stand 13, the voltages V1, V2, and V3 return to the relation as $V1<V2<V3$ so that the transistors Q2 and Q3 sequentially move into conductive states. As a result, the capacitor C1 is quickly discharged and the oscillation circuit 21 is deactivated. The deactivation of the oscillation circuit 21 causes the auditorily informing device 8 to interrupt the generation of the warning sound. The interruption of the generation of the warning sound informs the user that the electric power resstarts to be supplied to the heater 2 within the iron body 1. This action enables efficient use of the iron. These processes are shown in FIG. 8.

Figure 9:
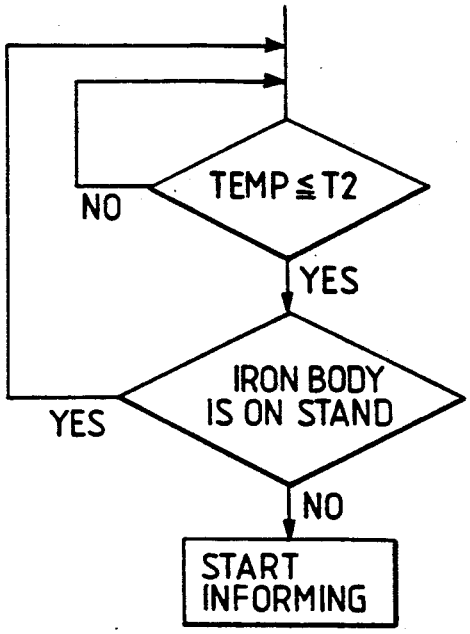
FIG. 9 is a flow diagram of a part of operation of the cordless iron of FIG. 1.
Figure 10:
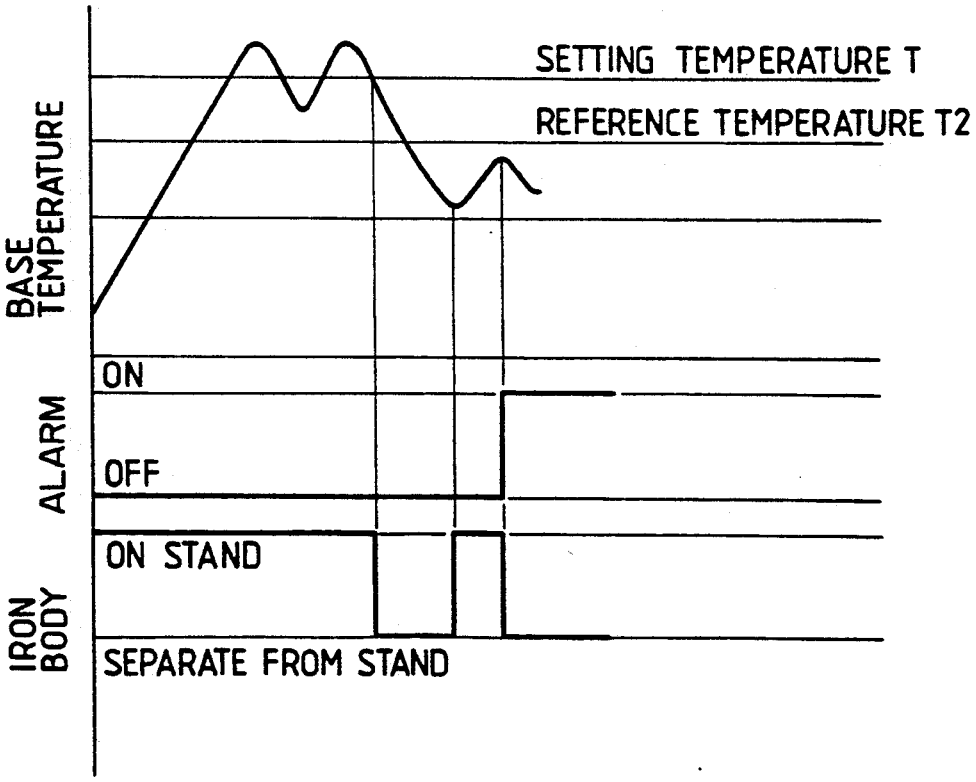
FIG. 10 is a timing diagram related to the operation of FIG. 9.

As shown in FIGS. 9 and 10, in the case where the iron body 1 is detached from the stand 13 before the temperature of the sole plate 3 returns to a value equal to or above a reference temperature T2, the audible alarm device 8 is activated. This action is realized by the following processes. In the case where the iron body 1 is placed on the stand 13, the voltage across the capacitor C1 is nullified so that the oscillation circuit 21 and the audible alarm device 8 remains deactivated. In the case where the iron body 1 is separated from the stand 13, the capacitor C1 is in the charged state so that the oscillation circuit 21 and the auditorily informing device 8 can be activated in response to the output signal from the comparator IC4. Specifically, in this case, when the temperature of the sole plate 3 is smaller than the reference temperature T2 which is determined by the resistors R1–R3, the comparator IC4 triggers the oscillation circuit 21 so that the auditorily informing device 8 is activated. Accordingly, the user is informed of an insufficient recovery of the temperature of the sole plate 3.

Figure 11:
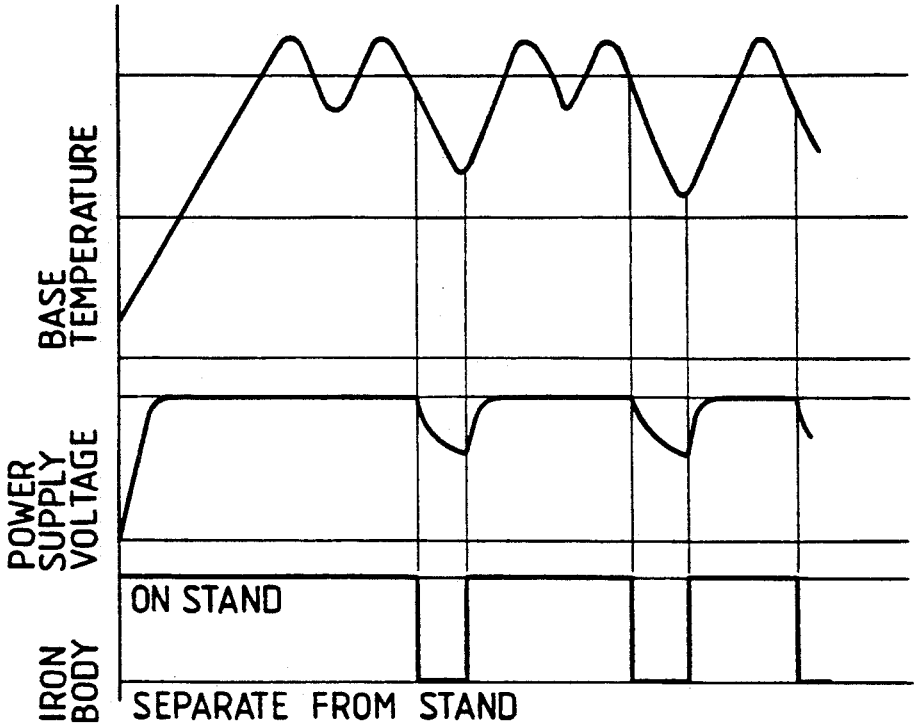
FIG. 11 is a timing diagram related to a part of operation of the cordless iron of FIG. 1.

As shown in FIG. 11, when the iron body 1 is placed on the stand 13, the power supply 9 is charged. Specifically, when the iron body 1 is placed on the support portion 17 of the stand 13, the terminals 10–12 of the iron body 1 are connected to the terminals 14–16 of the stand 13 respectively and thus the transistor Q1 moves into the conductive state so that the power supply 9 starts to be charged. When the iron body 1 is detached from the stand 13, the power supply 9 feeds drive currents to the temperature sensor 6, the temperature signal processor 7, the oscillation circuit 21, and other circuits within the iron body 1. During the separation of the iron body 1 from the stand 13, the temperature sensor 6, the temperature signal processor 7, the oscillation circuit 21, and other circuits thus remain powered although the voltage of the power supply 9 gradually drops. The power supply 9 is recharged upon a subsequent placement of the iron body 1 on the stand 13. Accordingly, the comparator IC4 can accurately detect that the temperature of the sole plate 3 drops below the reference temperature T1.

Figure 12:
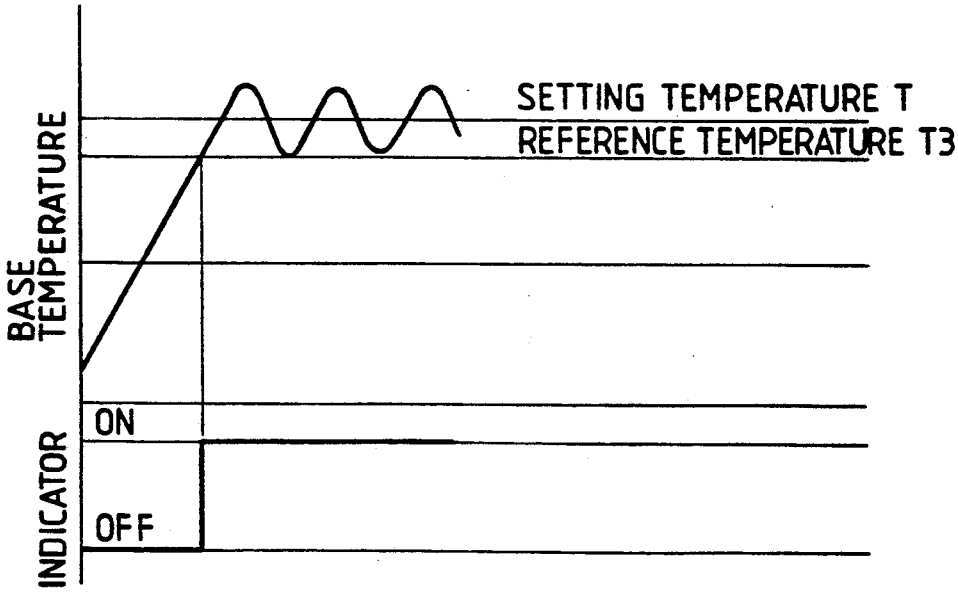
FIG. 12 is a timing diagram related to a part of operation of the cordless iron of FIG. 1.

As shown in FIG. 12, when the temperature of the sole plate 3 of the iron body 1 increases to or above a reference temperature T3, the indicator 22 is activated. The reference temperature T3 is determined by the values of the resistors R1–R3 and is given as follows.

$$T3 = V2 \cdot (R1//R3)/((R1//R3)+R2)$$

where V2 denotes the voltage of the power supply 9 (see FIG. 5) and the character "R1//R3" denotes "(R1·R3)/(R1+R3)". When the temperature of the sole plate 3 increases to or above the reference temperature T3, the comparator IC4 outputs a high-level signal to the transistor Q5 so that the transistor Q5 becomes conductive and the LED 22 is activated. In this way, the user is visually informed of a sufficient increase in the temperature of the sole plate 3. The reference temperature T3 is preferably equal to the reference temperature T2. The reference temperature T3 may be different from to the reference temperature T2.

Figure 5:
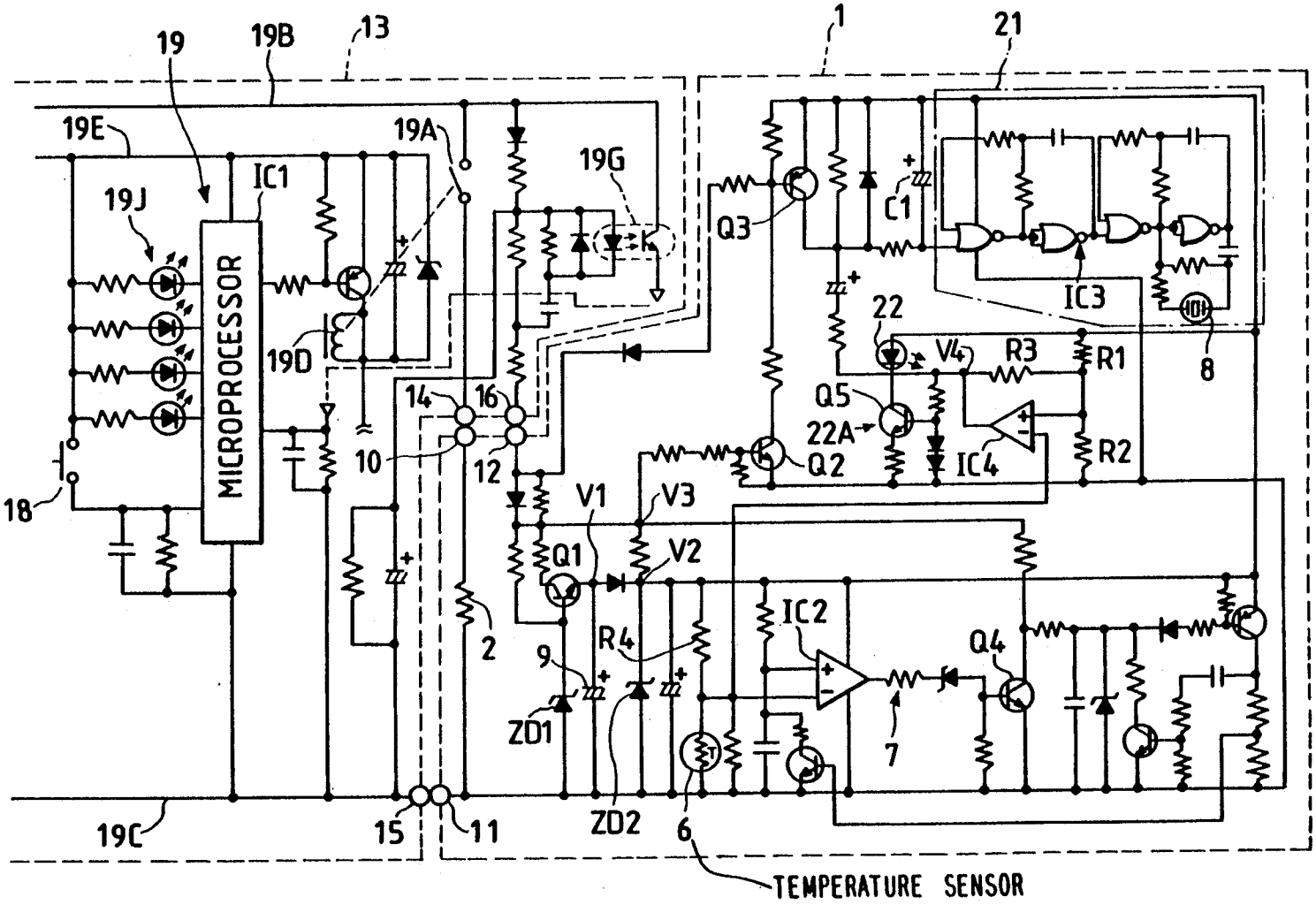
FIG. 5 is a schematic diagram of the electric part of the cordless iron of FIG. 1.
Figure 13:
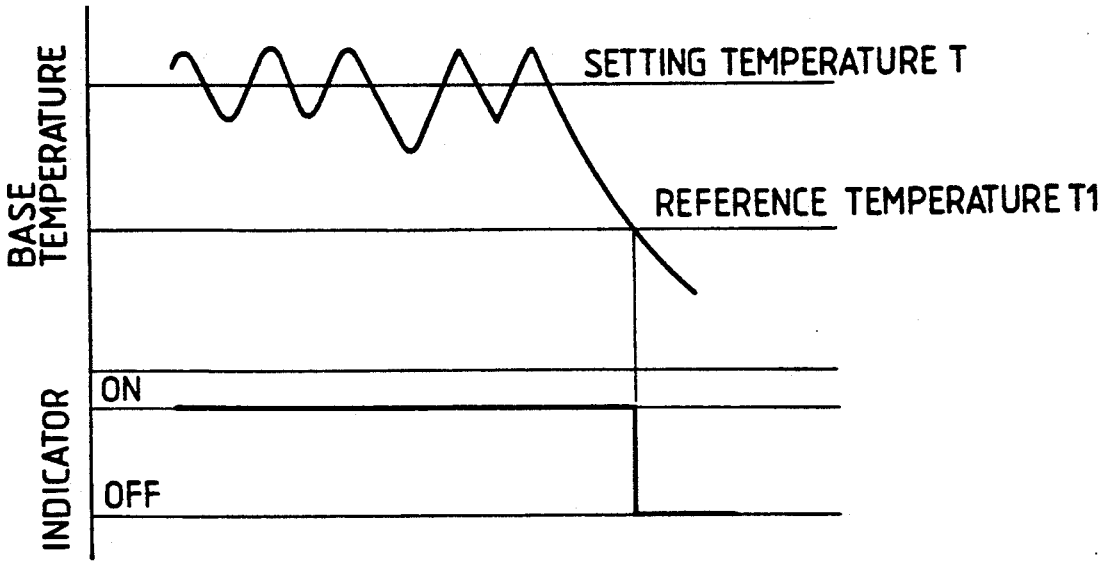
FIG. 13 is a timing diagram related to a part of operation of the cordless iron of FIG. 1.

As shown in FIG. 13, when the temperature of the sole plate 3 of the iron body 1 drops to or below the reference temperature T1, the indicator 22 is activated. The reference temperature T1 is given as follows.

$$T1 = V2 \cdot R1/(R1+(R2//R3))$$

where V2 denotes the voltage of the power supply 9 (see FIG. 5). When the temperature of the sole plate 3 drops to or below the reference temperature T1, the comparator IC4 outputs a low-level signal to the transistor Q5 so that the LED 22 is deactivated. In this way, the user is visually informed of an unacceptable drop in the temperature of the sole plate 3.

Figure 14:
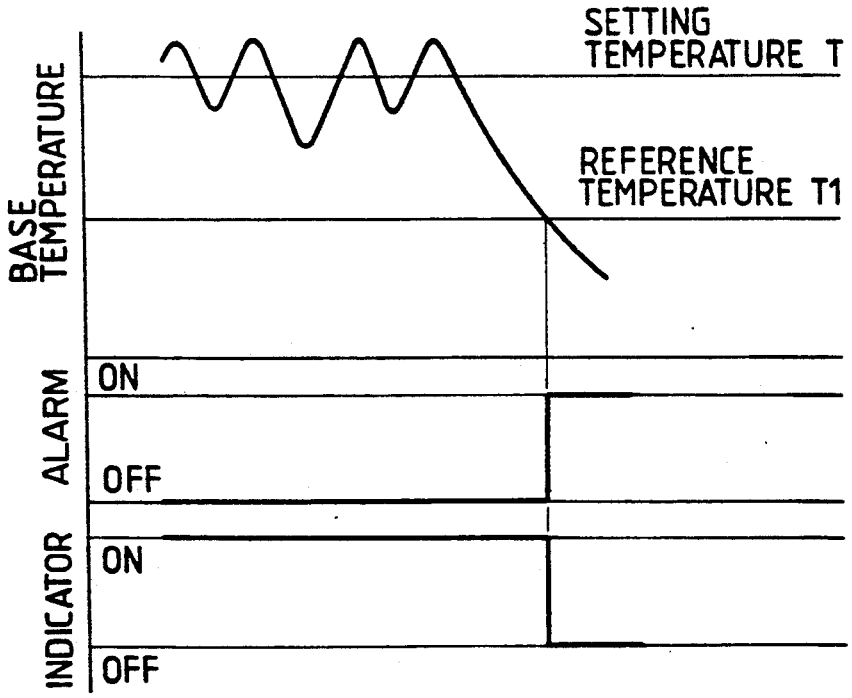
FIG. 14 is a timing diagram related to a part of operation of the cordless iron of FIG. 1.

The relation between the operation of the auditorily informing device 8 and the operation of the indicator 22 will be described hereinafter. As shown in FIG. 14, when the temperature of the sole plate 3 of the iron body 1 drops to or below the reference temperature T1, the auditorily informing device 8 is activated and simultaneously the indicator 22 is deactivated. In this way, the user is auditorily and visually informed of an unacceptable drop in the temperature of the sole plate 3.

DESCRIPTION OF THE SECOND PREFERRED EMBODIMENT

Figure 15:
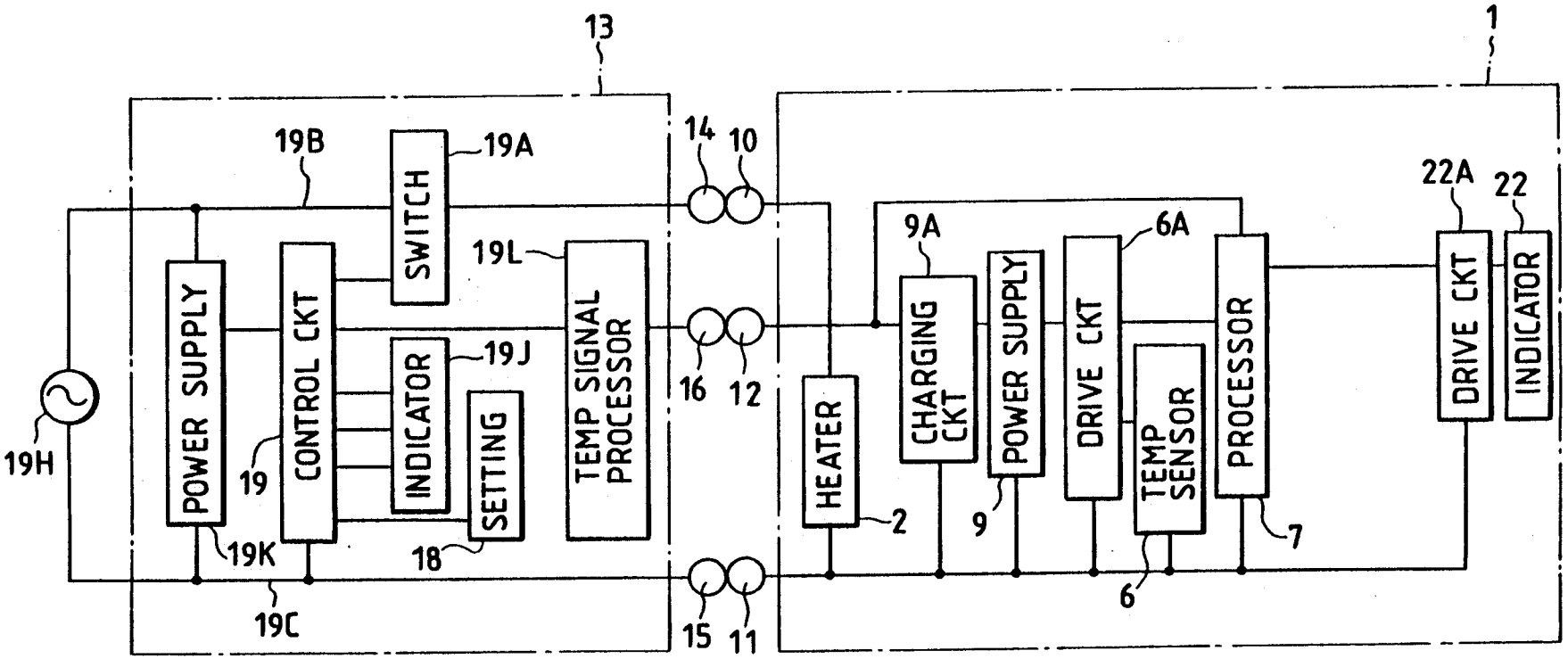
FIG. 15 is a block diagram of an electric part of a cordless iron according to a second embodiment of this invention.
Figure 16:
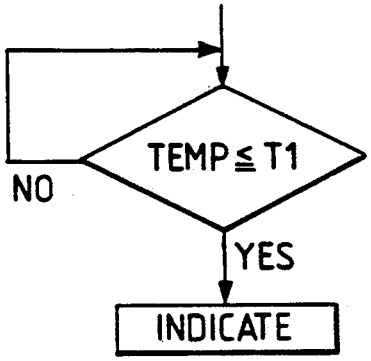
FIG. 16 is a flow diagram of a part of operation of the cordless iron of FIG. 15.
Figure 17:
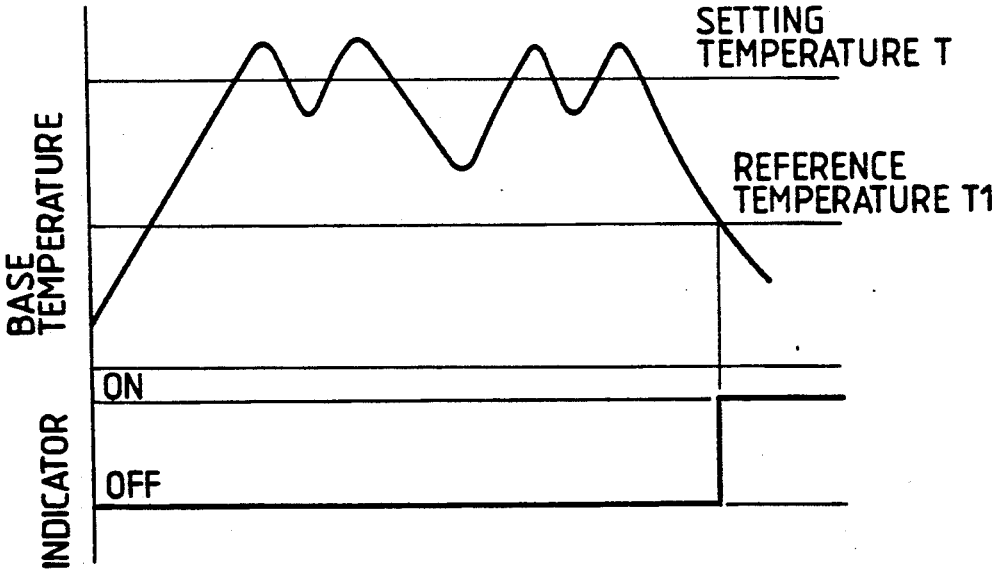
FIG. 17 is a timing diagram related to the operation of FIG. 16.

FIGS. 15–17 relate to a second embodiment of this invention which is similar to the embodiment of FIGS. 1–14 except for design changes indicated hereinafter.

The oscillation circuit 21 (see FIG. 4) and the audible alarm device 8 (see FIG. 4) are omitted from the embodiment of FIGS. 15–17. In addition, in the embodiment of FIGS. 15–17, the indicator drive circuit 22A is modified so that the indicator 22 will be activated when the temperature of the sole plate 3 of the iron body 1 drops to or below the reference temperature T1 (see FIGS. 16 and 17). Specifically, in the embodiment of FIGS. 15–17, an inverter is additionally disposed between the comparator IC4 (see FIG. 5) and the transistor Q5 (see FIG. 5).

DESCRIPTION OF THE THIRD PREFERRED EMBODIMENT

Figure 18:
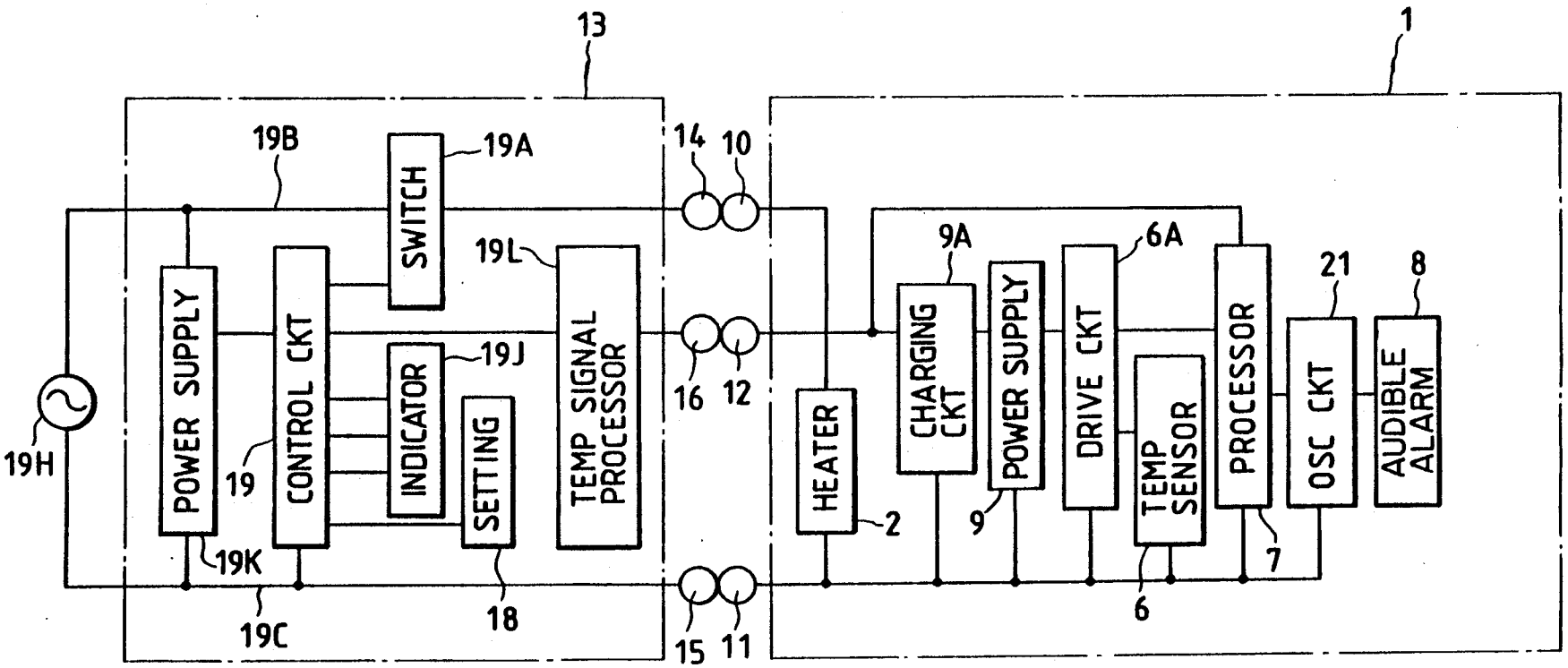
FIG. 18 is a block diagram of an electric part of a cordless iron according to a third embodiment of this invention.

FIG. 18 shows a third embodiment of this invention which is similar to the embodiment of FIGS. 1–14 except that the indicator drive circuit 22A (see FIG. 4) and the indicator 22 (see FIG. 4) are removed.

What is claimed is:

1. A cordless iron comprising:

a stand;

an iron body placeable on and detachable from the stand and having a sole plate;

means for heating the sole plate of the iron body when the iron body is placed on the stand;

means for sensing a temperature of the sole plate of the iron body and outputting a signal representative of the sensed temperature of the sole plate of the iron body, said temperature sensing means comprising an electrically powered temperature sensor;

means responsive to the signal outputted from the sensing means for informing that the sensed temperature drops to or below a reference temperature; and means for keeping the sensing means activated when the iron body is detached from the stand.

2. The cordless iron of claim 1 further comprising means for deactivating the informing means when the iron body is placed on the stand.

3. The cordless iron of claim 1 further comprising means for informing that the iron body is detached from the stand under a condition where the temperature of the sole plate of the iron body is equal to or below the reference temperature.

4. The cordless iron of claim 1 wherein the keeping means comprises a power supply; and further comprising means for charging the power supply when the iron body is placed on the stand.

5. A cordless iron comprising:

a stand;

an iron body placeable on and detachable from the stand and having a sole plate;

means for heating the sole plate of the iron body when the iron body is placed on the stand;

means for sensing a temperature of the sole plate of the iron body and outputting a signal representative of the sensed temperature of the sole plate of the iron body, said temperature sensing means comprising an electrically powered temperature sensor;

means responsive to the signal outputted from the sensing means for indicating that the sensed temperature drops to or below a reference temperature; and means for keeping the sensing means activated when the iron body is detached from the stand.

6. The cordless iron of claim 5 wherein said means responsive to the signal outputted from the sensing means indicates that the sensed temperature is in a predetermined acceptable range including said reference temperature.

7. The cordless iron of claim 5 wherein said means responsive to the signal outputted from the sensing means indicates that the sensed temperature is in a predetermined unacceptable range not including said reference temperature.

8. A cordless iron comprising:

a stand;

an iron body placeable on and detachable from the stand and having a sole plate;

means for heating the sole plate of the iron body when the iron body is placed on the stand;

means for sensing a temperature of the sole plate of the iron body and outputting a signal representative of the sensed temperature of the sole plate of the iron body, said temperature sensing means comprising an electrically powered temperature sensor;

means responsive to the signal outputted from the sensing means for audibly informing that the sensed temperature drops to or below a reference temperature;

means responsive to the signal outputted from the sensing means for visually informing that the sensed temperature drops to or below the reference temperature; and means for keeping the sensing means activated when the iron body is detached from the stand.

9. A cordless iron comprising:

a stand;

an iron body placeable on and detachable from the stand and having a sole plate;

means for heating the sole plate of the iron body when the iron body is placed on the stand;

means for sensing a temperature of the sole plate of the iron body and outputting a signal representative of the sensed temperature of the sole plate of the iron body, said temperature sensing means comprising an electrically powered temperature sensor;

means responsive to the signal outputted from the sensing means for informing that the sensed temperature drops to or below the reference temperature;

means for keeping the sensing means activated when the iron body is detached from the stand, wherein the keeping means comprises a power supply;

means for charging the power supply when the iron body is placed on the stand; and means for deactivating the informing means when the iron body is placed on the stand.

10. A cordless iron comprising:

a stand;

an iron body placeable on and detachable from the stand and having a sole plate;

means for heating the sole plate of the iron body when the iron body is placed on the stand;

means for deactivating the heating means when the iron body is detached from the stand, whereby a temperature of the sole plate of the iron body gradually drops when the iron body is detached from the stand;

means for sensing the temperature of the sole plate of the iron body and outputting a signal representative of the sensed temperature of the sole plate of the iron body, said temperature sensing means comprising an electrically powered temperature sensor;

means responsive to the signal outputted from the sensing means for, while the iron body remains detached from the stand, informing that the sensed temperature drops into a predetermined range; and means for keeping the sensing means activated to enable the sensing means to continuously sense the temperature of the sole plate of the iron body while the iron body remains detached from the stand;

wherein the informing means is responsive to the signal which is currently outputted from the sensing means while the iron body remains detached from the stand.

* * * * *